United States Patent [19]

Johnson et al.

[11] 4,056,113

[45] Nov. 1, 1977

[54] LIQUID DETERGENT COMPOSITIONS FOR REMOVAL OF COOKED-ON FOOD SOILS

[75] Inventors: Eric M. Johnson, Blyth; Graeme D. Murray; Frederick E. Hardy, both of Newcastle-on-Tyne, all of England

[73] Assignee: The Procter & Gamble Company, Cincinnati, Ohio

[21] Appl. No.: 719,312

[22] Filed: Aug. 31, 1976

Related U.S. Application Data

[63] Continuation of Ser. No. 503,123, Sept. 4, 1974, abandoned.

[30] Foreign Application Priority Data

Sept. 4, 1973 United Kingdom ..... 41496/73
Mar. 15, 1974 United Kingdom ..... 11628/74

[51] Int. Cl.[2] ..... C11D 3/065; C11D 3/43; C11D 17/08; C23G 5/00

[52] U.S. Cl. ..... 134/40; 134/39; 252/139; 252/153; 252/173; 252/526; 252/545; 252/DIG. 14

[58] Field of Search ..... 252/DIG. 14, 111, 117, 252/118, 139, 153, 526, 545, 173; 134/39, 40

[56] References Cited

U.S. PATENT DOCUMENTS

| | | | |
|---|---|---|---|
| 3,528,922 | 9/1970 | Wagner | 252/118 |
| 3,634,271 | 1/1972 | Friedman | 252/545 |
| 3,793,219 | 2/1974 | Kashiwa | 252/526 |
| 3,793,233 | 2/1974 | Rose | 252/547 |
| 3,813,349 | 5/1974 | Wolfson | 252/526 |
| 3,869,399 | 3/1975 | Collins | 252/118 |

FOREIGN PATENT DOCUMENTS

| | | | |
|---|---|---|---|
| 919,249 | 2/1963 | United Kingdom | 252/111 |

*Primary Examiner*—Dennis L. Albrecht
*Attorney, Agent, or Firm*—Steven J. Goldstein; Monte D. Witte; Robert B. Aylor

[57] ABSTRACT

Liquid detergent compositions comprising anionic surfactant and phosphate builder in which the cations are monoethanolammonium or monoethanolammonium in admixture with ammonium, sodium, potassium, calcium, and magnesium cations. The compositions are particularly suited for removing cooked-on foods from cooking utensils.

16 Claims, No Drawings

LIQUID DETERGENT COMPOSITIONS FOR REMOVAL OF COOKED-ON FOOD SOILS

This is a continuation of U.S. patent application Ser. No. 503,123, filed Sept. 4, 1974, now abandoned.

BACKGROUND OF THE INVENTION

This invention relates to liquid detergent compositions particularly suitable for dishwashing and the use of which facilitates the removal of cooked-on food soils from cooking utensils.

The removal of cooked-on food soils from cooking utensils is one of the more difficult and tedious household tasks and it is common practice to leave such soiled utensils soaking in water or detergent solution for a considerable time before attempting to remove the soil. Even then the use of scouring pads or abrasives is frequently necessary for satisfactory removal of the soil.

SUMMARY OF THE INVENTION

It has now been discovered that the task of removing cooked-on food soils from cooking utensils can be facilitated by soaking the soiled utensils in a detergent solution which contains an anionic synthetic detergent and a phosphate builder, at least part of the cations of the synthetic detergent and builder being derived from monoethanolamine, the remaining cations being selected from ammonium, sodium, potassium, calcium and magnesium and the solution optionally also containing free organic base.

Detergent compositions suitable for providing such solutions can be prepared, according to the invention, in the form of single phase liquid detergent compositions.

DETAILED DESCRIPTION OF THE INVENTION

According to the invention, a clear, single-phase, liquid detergent composition comprises from 26–50% by weight of the composition of anionic detergents selected from the group consisting of linear alkyl benzene sulfonates having from 8–18 carbon atoms in the alkyl radical, alkyl sulfates having from 10 to 20 carbon atoms, paraffin sulfonates having from 10–20 carbon atoms, alkyl polyglycol ether sulfates having from 10–20 carbon atoms in the alkyl group and from 1–6 ethoxy groups in the molecule and mixtures thereof, 0.5–15% by weight of the composition of anion of a condensed phosphoric acid, optionally in admixture with orthophosphoric acid, the composition being solubilized in water with a lower alcohol having from 1–3 carbon atoms, 0–10% by weight of the composition of mono- or di- lower alkyl benzene sulfonate having from 1 to 3 carbon atoms total in the alkyl groups, the cations of the detergent, the phosphoric salts and the optional lower alkyl or dialkyl benzene sulfonate being solely monoethanolammonium ($HO.CH_2.CH_2NH_3^+$) or a mixture of monoethanolammonium with ammonium ($NH_4^+$), sodium ($Na^+$), potassium ($K^+$), calcium ($Ca^{++}$) or magnesium ($Mg^{++}$) cations in which not less than 20 mole percent of the total cations are monoethanolammonium. The anionic detergent can be replaced in an amount not greater than 10% by weight of the composition by a suds enhancing agent selected from the group consisting of alkyl glyceryl ether sulfonates in which the alkyl group has 10 to 20 carbon atoms, tertiary amine oxides of the formula $R_1R_2R_3N \rightarrow O$ in which $R_1$ is an alkyl group of 10 to 18 carbon atoms and $R_2$ and $R_3$ are each alkyl groups of from 1 to 3 carbon atoms, and fatty acid mono- or dialkylolamide in which the fatty acid radical has from 8 to 18 carbon atoms and the alkylol radical has from 1 to 3 carbon atoms. In compositions containing no ammonium cation, the lower alkyl or dialkylbenzene sulfonate can be replaced, wholly or in part, by free monoethanolamine as hereinafter defined.

By free monoethanolamine in the compositions of the invention is meant monoethanolamine which is in excess of that required to adjust the pH of the composition to 7.5.

Preferably, the anionic detergent is a mixture of alkyl sulfate and alkyl polyglycol ether sulfate in a weight ratio of 3:1 to 1:3, preferably substantially 1:1. The total proportion of active detergent is preferably 30–45% by weight of the total composition. When a suds enhancing agent is present, it is preferably a fatty acid mono- or dialkylolamide and is preferably present at a level of 2–8% by weight of the total composition.

Condensed phosphates suitable for use in the compositions are pyrophosphates and the salts of linear polyphosphoric acid which have a mole ratio of $H_2O$ to $P_2O_5$ less than 2:1. Optionally some orthophosphoric acid may also be present. Suitable phosphoric acids are commercial mixtures available under the trade names "Conphos", "Pyrophosphoric acid" and "Tetraphosphoric acid" which have the compositions set out below.

| | "Conphos" | "Pyrophosphoric Acid" | "Tetraphosphoric Acid" |
|---|---|---|---|
| Total $P_2O_5$ | 76% | 79.5% | 84.5% |
| | Approx. molecular compositions % by wt. of Total $P_2O_5$ | | |
| Orthophosphoric Acid ($H_3PO_4$) | 54 | 22 | 3 |
| Pyrophosphoric Acid ($H_4P_2O_7$) | 41 | 46 | 9 |
| Triphosphoric Acid ($H_5P_3O_{10}$) | 5 | 20 | 10 |
| Tetraphosphoric Acid ($H_6P_4O_{13}$) | — | 8 | 11 |
| More condensed acids | — | 4 | 67 |
| Empirical Formula | — | $H_4P_2O_7$ | $H_6P_4O_{13}$ |

The cations of the detergent, phosphate and optional lower mono- or dialkylbenzene sulfonate may be solely monoethanolammonium or a mixture of monoethanolammmonium with ammonium, sodium, potassium, calcium or magnesium cations. At least 20 mole percent of the cations are monoethanolammonium. In the preferred compositions which contain a mixture of alkyl polyglycol ether sulfate detergent with alkyl sulfate detergent, it is preferred that the monoethanolammonium cation should be equivalent to at least all of the alkyl polyglycol ether sulfate and the phosphate.

Compositions which do not contain ammonium ions may contain free (as defined above) monoethanolamine in place of some or all of the alkyl- or dialkylbenzene sulfonate hydrotropes. This free monoethanolamine serves to solubilize the other ingredients of the composition in the aqueous vehicle, and also at levels of 2 to 10% by weight of the composition it improves the effectiveness of the composition in removing cooked-on food stains. Even if some ammonium ion is present, small proportions of free monoethanolamine (e.g. up to 2% by weight of the composition) can be included provided the amount is not so great as to give rise to an objectionable ammonium odor.

The proportion of lower alcohol is sufficient to solubilize the detergent ingredients and is usually from 3 to 15% by weight of the composition. The preferred alcohol, for reasons of availability, odor and non-toxicity is ethanol in, for example, the form of industrial methylated spirit.

The lower alkyl or dialkyl benzene sulfonate, preferably a toluene sulfonate or xylene sulfonate, serves as a hydrotrope and may be present in an amount up to 10% by weight of the composition. However, as is mentioned above, this hydrotrope ingredient is optional in that it is not necessary in all compositions.

The compositions of the invention may contain minor proportions of the usual additives of dishwashing compositions such as color, perfume, tarnish inhibitor, viscosity control agents, etc.

The products of this invention can be used as conventional dishwashing agents, in which case they are preferably used at a concentration of from 0.05 to 0.5% by weight, preferably about 0.15%. Alternatively, saucepans and like utensils having cooked-on food stains may be left to soak in a somewhat stronger solution, e.g. 0.5 to 2%, preferably 1%, preferably for about 30 minutes to 1 hour, after which they can be washed in the same solution or in a conventional dishwashing solution. In such conditions the cooked-on soil is more easily removed by light rubbing, e.g. with a dishcloth, than is the case if an attempt is made to wash the utensils without a pre-soak or after a pre-soak in a solution of a conventional dishwashing liquid.

EXAMPLE I

| Composition No. | 1 | 2 | Control |
|---|---|---|---|
| | % by weight of total composition | | |
| * Ammonium linear alkyl benzene sulfonate | 14.8 | — | 18.4 |
| ** Sodium alkyl polyglycol ether sulfate | — | — | 18.4 |
| ** Ammonium alkyl polyglycol ether sulfate | 14.6 | — | — |
| * Monoethanolammonium linear alkyl benzene sulfonate | 4.2 | 20.8 | — |
| ** Monoethanolammonium alkyl polyglycol ether sulfate | 4.0 | 20.1 | — |
| Lauric monoethanolamide | 4.5 | 5.5 | 4.5 |
| *** Coconut diethanolamide | 2.0 | 1.0 | — |
| Monoethanolammonium pyrophosphate $[(HOC_2H_4.\ NH_3)_3HP_2O_7)]$ | 22.4 | 11.2 | — |
| Free monoethanolamine | | 5.5 | |
| Ammonium xylene sulfonate | 2.0 | — | — |
| Industrial methylated spirit | 10.0 | 12.0 | 13.0 |
| Water and minor components | Balance | Balance | Balance |

* Alkyl group has average of 11.8 carbon atoms.
** Sulfated condensation product of one mole middle cut coconut fatty alcohol and three moles ethylene oxide.
*** From middle cut coconut fatty acid.

The Control Composition is a conventional liquid dishwashing composition included for comparison.

The above three compositions have substantially equal sudsing characteristics.

Cleaning Test

Aluminum saucepans were used to prepare boiled milk and the milk was then poured out of the pan without scraping the layer of cooked milk adhering to the pan surface. The pans were filled with 1.0% solutions of the test products at room temperature. The pans were left soaking for 30 minutes and the liquid was then poured out. The pans were rinsed for two ten-second periods under a cold running tap.

Four replicate pans were prepared for each product. The treated pans were panelled using a 9-level Scheffé paired comparison technique (H. Scheffé, J. Am. Statist. Ass., 47, 381–400 (1952)).

In this test, Product 1 had a 2.0 panel score unit (psu) advantage over the Control Product and Product 2 had a 4.0 psu advantage over the Control Product. The least significant difference (95% confidence level) was 1.0 psu.

In a similar test using meat and vegetables prepared in pyrex casserole dishes, the same psu advantages over the Control Product were obtained with Products 1 and 2.

EXAMPLE II

| Composition No. | 3 | 4 | 5 |
|---|---|---|---|
| | % by weight of total composition | | |
| * Monoethanolamine benzene sulfonate | 20.83 | — | 16.5 |
| ** Monoethanolamine alkyl polyglycol ether sulfate | 20.11 | 10.2 | 16.5 |
| *** Sodium paraffin sulfonate | — | 28.0 | 10.0 |
| **** "Conphos" | 1.0 | 1.0 | 1.0 |
| Monoethanolamine | 6.0 | 6.0 | 6.0 |
| Industrial methylated | 11.0 | 5.0 | 7.0 |
| Water | Balance | Balance | Balance |

* Alkyl group has average of 11.8 carbon atoms.
** Sulfated condensation product of one mole of middle cut coconut alcohol with three moles of ethylene oxide.
*** Secondary alkane sulfonate with 14-16 carbon atoms.
**** "Conphos" of the composition shown above.

In each of the compositions of Example II, of the 6.0% added monoethanolamine, 1.2% is required to neutralize the "Conphos", leaving 4.8% free monoethanolamine. Other effective compositions of the invention which are all clear single phase liquids are:

| Composition No. | 6 | 7 | 8 | 9 | 10 | 11 | 12 |
|---|---|---|---|---|---|---|---|
| * Sodium paraffin sulfonate | | 20.0 | 10.0 | | | | |
| ** Magnesium alkyl sulfate | | | | | | | |

-continued

| | | | | | | | |
|---|---|---|---|---|---|---|---|
| *** Magnesium alkyl polyglycol ether sulfate | | | | | | | |
| **** Monoethanolamine linear alkyl benzene sulfonate | 20.83 | | 16.5 | | | | |
| ** Monoethanolamine alkyl sulfate | | | | 14.7 | 12.0 | 10.0 | 10.0 |
| *** Monoethanolamine alkyl polyglycol ether sulfate | 20.11 | 21.8 | 16.5 | 14.7 | 12.0 | 16.0 | 16.0 |
| Dodecyldimethyl amine oxide | | | | | | 4.0 | 4.0 |
| ** Sodium alkyl glyceryl ether sulfate | | | | | | | |
| Lauric monoethanolamide | 2.0 | | | 5.0 | 5.5 | 4.0 | |
| Free monoethanolamine | 4.8 | 4.8 | 4.8 | 4.8 | 4.8 | 4.8 | 4.8 |
| MEA salt of "Conphos" | 2.2 | 2.2 | 2.2 | 2.2 | 2.2 | 2.2 | 2.2 |
| Sodium xylene sulfonate | | | | | | | |
| Industrial methylated spirit | 10.0 | 6.0 | 7.0 | 10.0 | 9.0 | 9.0 | 9.0 |
| Water | ← Balance → | | | | | | |

| Composition No. | 13 | 14 | 15 | 16 | 17 | 18 |
|---|---|---|---|---|---|---|
| * Sodium paraffin sulfonate | | | | | | |
| ** Magnesium alkyl sulfate | | | | | | 2.5 |
| *** Magnesium alkyl polyglycol ether sulfate | | | | | | 2.5 |
| **** Monoethanolamine linear alkyl benzene sulfonate | 15.0 | 15.0 | 8.5 | 10.5 | 12.0 | 28.0 |
| ** Monoethanolamine alkyl sulfate | | | | | | |
| *** Monoethanolamine alkyl polyglycol ether sulfate | 15.0 | 15.0 | 8.5 | 10.5 | 12.0 | |
| Dodecyldimethyl amine oxide | 10.0 | 5.0 | | | | |
| ** Sodium alkyl glyceryl ether sulfate | | | 10.0 | 5.0 | | |
| Lauric monoethanolamide | | | | | 10.0 | |
| Free monoethanolamine | 4.8 | 4.8 | 1.8 | 1.8 | 4.8 | |
| MEA salt of "Conphos" | 2.2 | 2.2 | 2.2 | 2.2 | 2.2 | 11.0 |
| Sodium xylene sulfonate | | | 2.0 | 1.0 | | |
| Industrial methylated spirit | 15.0 | 15.0 | 15.0 | 15.0 | 15.0 | 15.0 |
| Water | Balance | | | | | |

*Secondary alkane sulfonate with 14–16 carbon atoms.
**Alkyl chain averages about 12 carbon atoms.
***Sulfate condensation product of one mole of middle cut coconut alcohol with three moles of ethylene oxide.
****Alkyl group has average of 11.8 carbon atoms.

What is claimed is:

1. A clear single-phase liquid detergent composition comprising from 26 to about 50% by weight of the composition of anionic detergent selected from the group consisting of linear alkyl benzene sulfonates having from 8–18 carbon atoms in the alkyl radical, alkyl sulfates having from 10–20 carbon atoms, paraffin sulfonates having from 10–20 carbon atoms, alkyl polyglycol ether sulfates having from 10–20 carbon atoms in the alkyl group and from 1–6 ethoxy groups in the molecule, and mixtures thereof; from about 0.5 to about 15% by weight of the composition of the anion of a condensed phosphoric acid; from 0 to 10% by weight of the composition of mono- or di-lower alkyl benzene sulfonate having a total of 1 to 3 carbon atoms in the alkyl group; wherein the cations of the detergent, the phosphoric acid salts and the mono- or di-lower alkyl benzene sulfonate are solely monoethanolammonium and wherein the composition is solubilized in water with a lower alcohol having from 1 to 3 carbon atoms.

2. The composition of claim 1 which contains as an additional component less than about 10% by weight of the composition of a suds enhancing agent selected from the group consisting of alkyl glyceryl ether sulfonates having 10–20 carbon atoms in the alkyl group, tertiary amine oxides of the formula $R_1R_2R_3N \rightarrow O$ in which $R_1$ is an alkyl group of from 10 to 18 carbon atoms and $R_2$ and $R_3$ are each alkyl groups of from 1 to 3 carbon atoms, and fatty acid mono- and dialkanolamides in which the fatty acid radical has from 10–18 carbon atoms and the alkylol radical has from 1–3 carbon atoms.

3. The composition of claim 2 which contains as an additional component free monoethanolamine.

4. The composition of claim 2 wherein said anionic detergent is present at from about 30 to about 50% by weight of the composition.

5. The composition of claim 4 wherein said anion of condensed phosphoric acid is present at from about 2.5 to about 15% by weight of the composition.

6. The composition of claim 5 wherein said anionic detergent is a mixture of said alkyl sulfate and said alkyl polyglycol ether sulfate in a weight ratio of from about 3:1 to about 1:3.

7. The composition of claim 1 wherein said lower alcohol is ethanol and is present at from about 5 to about 15% by weight of the composition.

8. A process for the removal of cooked-on food soils from cookware and tableware, comprising the steps of:

a. soaking said cookware and tableware in an aqueous solution comprising from about 0.5 to about 2%, by weight, of a clear single-phase liquid detergent composition comprising from 26 to about 50% by weight of the composition of anionic detergent selected from the group consisting of linear alkyl benzene sulfonates having from 8–18 carbon atoms in the alkyl radical, alkyl sulfates having from 10–20 carbon atoms, paraffin sulfonates having from 10–20 carbon atoms, alkyl polyglycol ether sulfates having from 10–20 carbon atoms in the alkyl group and from 1–6 ethoxy groups in the molecule, and mixtures thereof; from about 0.5 to about 15% by weight of the composition of the anion of a condensed phosphoric acid; from 0 to 10% by weight of the composition of mono- or di-lower alkyl benzene sulfonate having a total of 1 to 3 carbon atoms in the alkyl group; wherein the cations of the detergent, the phosphoric acid salts and the mono- or di-lower alkylbenzene sulfonate are mixtures of monoethanolammonium and at least one cation selected from the group consisting of ammonium, sodium, potassium, calcium, and magnesium, wherein said monoethanolammonium cation is present in an amount equal to at least 20 mole percent of the cation mixture; and wherein the composition is solubilized in water with from about 3 to about 15% of a lower alcohol having from 1 to 3 carbon atoms; and b. washing said cookware and tableware in an aqueous solution comprising from about 0.05 to about 2%, by weight, of said detergent composition.

9. The process according to claim 8 wherein the detergent composition contains as an additional component less than about 10% by weight of the composition of a suds enhancing agent selecting from the group consisting of alkyl glyceryl ethers sulfonates having 10–20 carbon atoms in the alkyl group, tertinary amine oxides of the formula $R_1R_2R_3N \rightarrow O$ in which $R_1$ is an alkyl group of from 10 to 18 carbon atoms and $R_2$ and $R_3$ are each alkyl groups of from 1 to 3 carbon atoms, and fatty acid mono- and di-alkanolamides in which the fatty acid radical has from 10–18 carbon atoms and the alkylol radical has from 1–3 carbon atoms.

10. The process according to claim 9 wherein the detergent composition contains cations which are a mixture of monoethanolammonium and at least 1 cation selected from the group consisting of sodium, potassium, calcium, and magnesium, wherein said monoethanolammonium cation is present in an amount equal to at least 20 mole percent of the cation mixture, and wherein said composition contains as an additional component up to about 10% by weight of free monoethanolamine.

11. The process according to claim 9 wherein the anionic detergent contained in said detergent composition is present at from about 30 to about 50% by weight of the composition.

12. The process according to claim 11 wherein the anion of condensed phosphoric acid is present at from about 2.5 to about 15% by weight of the detergent composition.

13. The process according to claim 12 wherein the anionic detergent contained in said detergent composition is a mixture of said alkyl sulfate and said alkyl polyglycol ether sulfate in a weight ratio of from about 3:1 to about 1:3.

14. The process according to claim 8 wherein said lower alcohol is ethanol and is present at from about 5% to about 15% by weight of the detergent composition.

15. The process according to claim 8 wherein the cookware and tableware are soaked in an aqueous solution comprising about 1% by weight of said detergent composition.

16. The process according to claim 8 wherein cookware and tableware are washed in an aqueous solution comprising about 0.15% by weight of said detergent composition.

* * * * *